US008640406B2

(12) United States Patent
Brunnhofer et al.

(10) Patent No.: US 8,640,406 B2
(45) Date of Patent: Feb. 4, 2014

(54) SPACER PROFILE HAVING A REINFORCEMENT LAYER

(75) Inventors: Erwin Brunnhofer, Kassel (DE); Petra Sommer, Kassel (DE); Joerg Lenz, Kassel (DE); Henrik Stephan, Kassel (DE)

(73) Assignee: Technoform Glass Insulation Holding GmbH, Kassel (DE)

( * ) Notice: Subject to any disclaimer, the term of this patent is extended or adjusted under 35 U.S.C. 154(b) by 0 days.

(21) Appl. No.: 13/575,384

(22) PCT Filed: Jan. 25, 2011

(86) PCT No.: PCT/EP2011/000312

§ 371 (c)(1),
(2), (4) Date: Jul. 26, 2012

(87) PCT Pub. No.: WO2011/091986

PCT Pub. Date: Aug. 4, 2011

(65) Prior Publication Data

US 2012/0297708 A1 Nov. 29, 2012

(30) Foreign Application Priority Data

Jan. 29, 2010 (DE) ..... 10 2010 006 127

(51) Int. Cl.
*E06B 7/00* (2006.01)

(52) U.S. Cl.
USPC ..... 52/204.595

(58) Field of Classification Search
USPC ..... 52/786.1, 786.13, 656.1, 656.2, 656.5, 52/786.11, 788.1, 795.1, 800.1, 204.593; 403/331, 253
See application file for complete search history.

(56) References Cited

U.S. PATENT DOCUMENTS 2,235,680 A 3/1941 Haven et al.
2,525,717 A 10/1950 Ottenheimer (Continued)

FOREIGN PATENT DOCUMENTS

CA 2269715 5/1998
DE 26 14 236 10/1977

(Continued)

OTHER PUBLICATIONS

English translation of International Preliminary Report on Patentability for parent International application No. PCT/EP2011/000312.

(Continued)

*Primary Examiner* — Mark Wendell
*Assistant Examiner* — Keith Minter
(74) *Attorney, Agent, or Firm* — J-Tek Law PLLC; Jeffrey D. Tekanic; Scott T. Wakeman

(57) ABSTRACT

A spacer profile for use as a spacer frame in an insulating window unit includes a profile body made of a synthetic material and having an inner wall, an outer wall and sidewalls, which define a chamber for hygroscopic material. A diffusion barrier layer is made of a first metal material and has a first tensile strength and a first thickness. The diffusion barrier layer is disposed at least on or in the outer wall and at least a portion of the sidewalls. A reinforcement layer is made of a second metallic material and has a second tensile strength and a second thickness. The reinforcement layer is formed in the inner wall or on the side of the inner wall, which is directed towards the chamber. The multiplication product of the second thickness and the second tensile strength is preferably greater than the multiplication product of the first thickness and the first tensile strength.

19 Claims, 6 Drawing Sheets

(56) References Cited

U.S. PATENT DOCUMENTS

| | | | | | |
|---|---|---|---|---|---|
| 2,741,809 | A | | 4/1956 | Englehart et al. | |
| 2,838,809 | A | | 6/1958 | Zeolla et al. | |
| 2,934,801 | A | | 5/1960 | Blaszkowski | |
| 2,974,377 | A | | 3/1961 | Kunkle | |
| 3,758,996 | A | | 9/1973 | Bowser | |
| 3,872,198 | A | | 3/1975 | Britton | |
| 3,998,680 | A | * | 12/1976 | Flint | 156/109 |
| 4,015,394 | A | | 4/1977 | Kessler | |
| 4,080,482 | A | * | 3/1978 | Lacombe | 428/34 |
| 4,149,348 | A | | 4/1979 | Pyzewski | |
| 4,407,105 | A | | 10/1983 | Frank | |
| 4,479,988 | A | * | 10/1984 | Dawson | 428/34 |
| 4,658,553 | A | * | 4/1987 | Shinagawa | 52/172 |
| 5,079,054 | A | * | 1/1992 | Davies | 428/35.8 |
| 5,125,195 | A | * | 6/1992 | Brede | 52/171.3 |
| 5,209,034 | A | * | 5/1993 | Box et al. | 52/171.3 |
| 5,302,425 | A | * | 4/1994 | Taylor | 428/34 |
| 5,313,762 | A | * | 5/1994 | Guillemet | 52/786.13 |
| 5,424,111 | A | * | 6/1995 | Farbstein | 428/137 |
| 5,439,716 | A | * | 8/1995 | Larsen | 428/34 |
| 5,460,862 | A | | 10/1995 | Roller | |
| 5,851,627 | A | * | 12/1998 | Farbstein | 428/137 |
| 5,962,090 | A | * | 10/1999 | Trautz | 428/34 |
| 6,061,994 | A | * | 5/2000 | Goer et al. | 52/786.13 |
| 6,192,652 | B1 | | 2/2001 | Goer et al. | |
| 6,339,909 | B1 | | 1/2002 | Brunnhofer et al. | |
| 6,389,779 | B1 | | 5/2002 | Brunnhofer | |
| 6,457,294 | B1 | * | 10/2002 | Virnelson et al. | 52/786.13 |
| 6,537,629 | B1 | | 3/2003 | Ensinger | |
| 6,796,102 | B2 | * | 9/2004 | Virnelson et al. | 52/786.13 |
| 7,827,760 | B2 | * | 11/2010 | Brunnhofer et al. | 52/786.13 |
| 7,997,037 | B2 | * | 8/2011 | Crandell et al. | 52/204.593 |
| 8,453,415 | B2 | * | 6/2013 | Brunnhofer et al. | 52/786.13 |
| 2003/0037493 | A1 | | 2/2003 | Guhl et al. | |
| 2005/0034386 | A1 | * | 2/2005 | Crandell et al. | 52/204.5 |
| 2006/0162281 | A1 | * | 7/2006 | Pettit et al. | 52/786.13 |
| 2006/0260227 | A1 | * | 11/2006 | Winfield | 52/204.593 |
| 2007/0261358 | A1 | | 11/2007 | Davis et al. | |
| 2008/0110109 | A1 | | 5/2008 | Hermens | |
| 2008/0134596 | A1 | | 6/2008 | Brunnhofer et al. | |
| 2009/0120035 | A1 | * | 5/2009 | Trpkovski | 52/786.13 |
| 2010/0107526 | A1 | | 5/2010 | Brunnhofer et al. | |
| 2012/0297707 | A1 | * | 11/2012 | Lenz et al. | 52/204.593 |

FOREIGN PATENT DOCUMENTS

| | | | |
|---|---|---|---|
| DE | 43 41 905 | | 6/1994 |
| DE | 94 08 764 | | 11/1995 |
| DE | 195 30 838 | A1 | 2/1997 |
| DE | 196 44 346 | | 4/1998 |
| DE | 198 05 265 | | 4/1999 |
| DE | 198 05 348 | A1 | 8/1999 |
| DE | 198 07 454 | A1 | 8/1999 |
| DE | 198 32 731 | A1 | 6/2000 |
| DE | 20 2005 016 444 | U1 | 3/2006 |
| DE | 20 2005 019 973 | U1 | 4/2006 |
| DE | 10 2004 062 060 | | 5/2006 |
| EP | 0 029 984 | | 6/1981 |
| EP | 601 488 | A2 | 6/1994 |
| EP | 1 017 923 | B1 | 8/2001 |
| EP | 0 953 715 | B1 | 4/2004 |
| EP | 1 099 038 | B1 | 4/2004 |
| FR | 1 475 287 | | 3/1967 |
| GB | 1 520 257 | | 8/1978 |
| WO | 00/05474 | | 2/2000 |
| WO | 2006/027146 | | 3/2006 |

OTHER PUBLICATIONS

Examination Report dated Oct. 13, 2010 from the German Patent & Trademark Office in priority German patent application No. 10 2010 006 127.1-25, including English translation of substantive portion thereof.

International Search Report for parent International application No. PCT/EP2011/000312.

* cited by examiner a) b)

a) b)

a) b)

a) b)

SPACER PROFILE HAVING A REINFORCEMENT LAYER

CROSS-REFERENCE

This application is the U.S. national stage of International Application No. PCT/EP2011/000312 filed on Jan. 25, 2011, which claims priority to German patent application no. 10 2010 006 127.1 filed on Jan. 29, 2010.

TECHNICAL FIELD

The present invention relates to a spacer profile for use in insulating window units having such a spacer profile.

RELATED ART

Insulating window units having at least two panes, which are held apart from each other in the insulating window unit, are known. Insulating panes are normally made from an inorganic or organic glass or from other materials such as Plexiglass. Normally, the separation of the window panes is secured by a spacer frame which is formed from at least one spacer profile. The spacer profile should exhibit a high thermal insulation. The spacer frame is preferably bent from one piece such that, after the bending, it can be closed by a connector at one position of the spacer frame.

The intervening space between the panes is preferably filled with an inert insulating gas, such as e.g., argon, krypton, xenon, etc. The filling gas should not be permitted to leak out of the intervening space between the panes. Moreover, it should also naturally not be possible for nitrogen, oxygen, water, etc., which are contained in the ambient air, to enter into the intervening space between the panes. For this reason, the spacer profile must prevent such a diffusion. Therefore, spacer profiles have a diffusion barrier layer which seals the intervening space between the panes from the surroundings. In so far as the term "impermeability" is utilized in the following description with respect to the spacer profile or materials forming the spacer profile, vapor impermeability as well as also gas impermeability for the gases relevant herein are meant.

Furthermore, the heat transmission of the edge bond, i.e. the bond of the frame of the insulating window unit, of the panes, and of the spacer frame, in particular plays a very important role for achieving low heat conduction in these insulating window units. Insulating window units, which ensure high terminal insulation along the edge bond, fulfill "warm edge"-conditions in accordance with the meaning of the term in the art.

WO 2006/027146 A1 shows a spacer profile for a spacer profile frame comprising a profile body made of synthetic material which has at least one chamber for accommodating hygroscopic material, and wherein a metal film encloses the profile body on three sides such that, in the assembled state of the spacer profile, the non-enclosed inner side of the profile body is directed towards the intervening space between the panes, and this not-enclosed inner side of the profile body comprises openings for moisture exchange between hygroscopic material accommodated in the chamber and the intervening space between the panes, and wherein the metal film has a profile with at least one angle or bend on the ends directed towards the intervening space.

Furthermore, a spacer in form of a hollow profile made of synthetic material and having at least one diffusion barrier layer is known from EP 0 601 488 A2, which at least one diffusion barrier layer is formed in the sidewalls and in the outer wall of the hollow profile. Further, the hollow profile has an insert in the inner wall of the hollow profile that faces towards the intervening space of the insulating window unit.

SUMMARY

It is an object of the present teachings to disclose a spacer profile for use as a spacer frame, which spacer profile is suitable to be mounted in and/or along an edge portion of an insulating window unit to form and maintain an intervening space between the window panes, and which spacer profile fulfills the "warm edge"-conditions, has the desired impermeability, and additionally enables a fast bending process.

The reinforcement layer can be designed so that it is thinner than the diffusion barrier layer, but it has an appropriately higher strength and/or an appropriately higher elastic modulus. Preferably, less heat is transferred through the comparatively thinner reinforcement layer.

The productivity of the bending process depends directly on the bending speed, i.e. the angular velocity, with which the profile is moved about the bending radius. For spacer profiles, the bending speed is limited to a maximum bending speed, which is due to the fact that, during the bending, lengthy profile portions are highly accelerated at longer distances from the bending radius and exceeding of the maximum bending speed results in unintended deformations.

By providing the additional reinforcement layer, a high quality result is achieved during the bending process, and additionally the maximum bending speed is considerably increased.

Further features and functionalities follow from the description of exemplary embodiments with the assistance of the Figures.

DETAILED DESCRIPTION OF THE INVENTION

Figure 1:
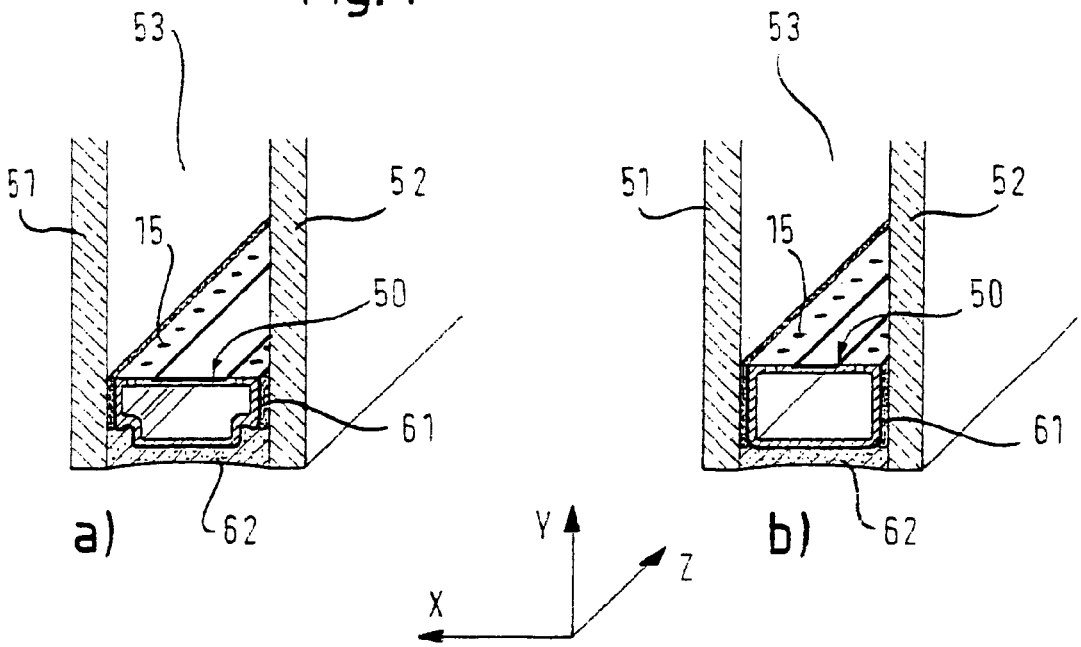
FIG. 1 shows in each of a) and b) a perspective cross-sectional view of the arrangement of the panes in an insulating window unit having disposed therebetween a spacer profile, adhesive material, and sealing material.
Figure 7:
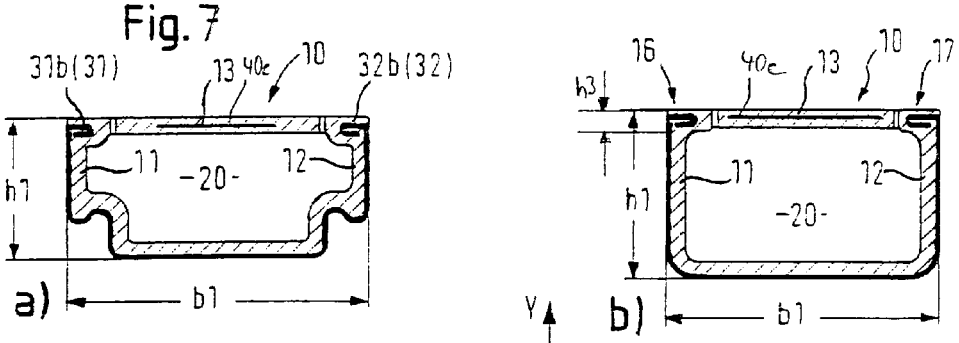
FIG. 7 shows a cross-sectional view of a spacer profile according to a fifth embodiment, in a) in a W-configuration, and in b) in a U-configuration.
Figure 10:
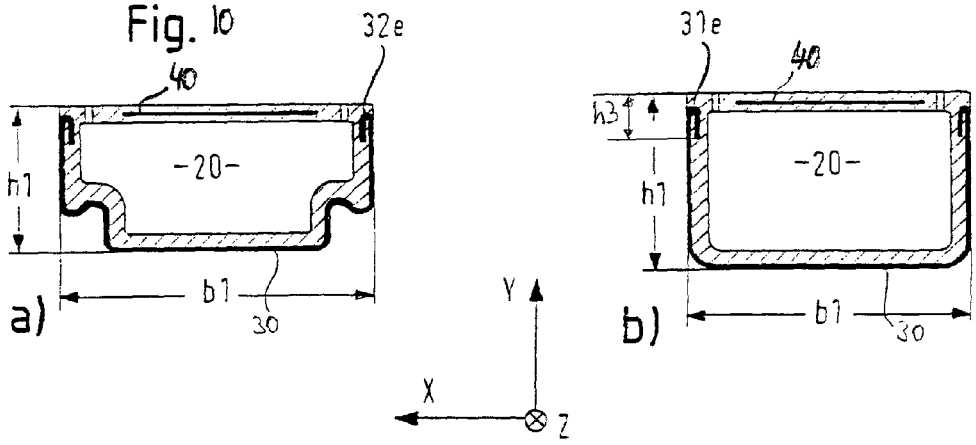
FIG. 10 shows a cross-sectional view of a spacer profile according to an eighth embodiment, in a) in a W-configuration, and in b) in a U-configuration.
Figure 11:
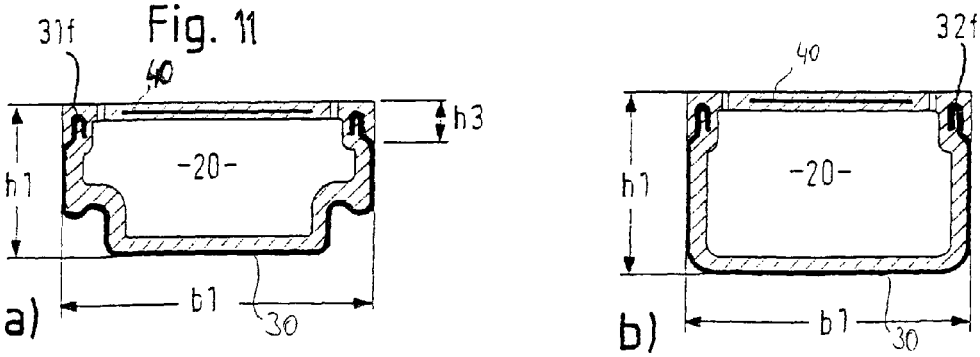
FIG. 11 shows a cross-sectional view of a spacer profile according to a ninth embodiment, in a) in a W-configuration and in b) in a U-configuration.
Figure 12:
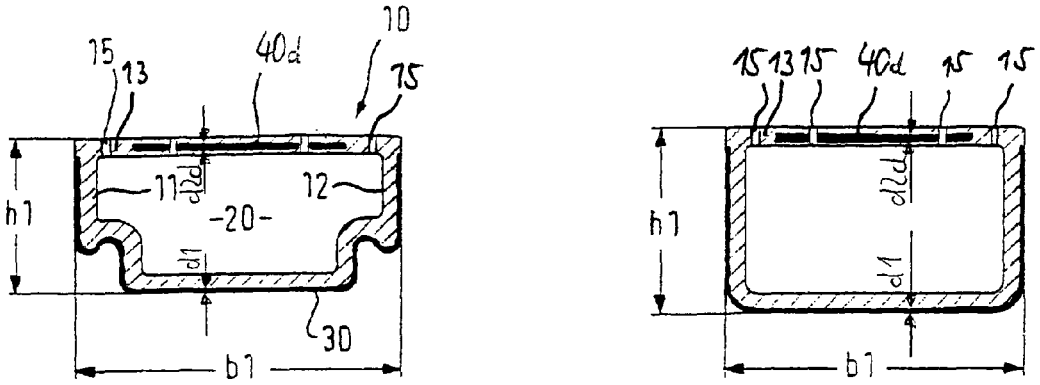
FIG. 12 shows a cross-sectional view of a spacer profile according to a tenth embodiment, in a) in a W-configuration, and in b) in a U-configuration.

Embodiments will be successively described with reference to the Figures. The same features/elements are denoted by the same reference symbols in all Figures. For the purpose of clarity, all reference symbols have not been inserted into all Figures. The coordinate system as shown in FIG. 1, between FIGS. 7 and 8, and between FIGS. 10 and 11 is valid in all Figures, the description and the claims. The longitudinal direction corresponds to direction Z, the lateral direction corresponds to direction X, and the height direction corresponds to direction Y.

In FIGS. 1 and 3 to 12, by way of example, are respectively shown a so-called W-configuration of the spacer profile in a), and a so-called U-configuration of the spacer profile in b). Now, a spacer profile according to the first embodiment will be described with reference to FIGS. 1*a*) and *b*), and 3*a*) and *b*).

FIG. 1 shows in each of a) and b) a perspective cross-sectional view of the arrangement of window panes 51, 52 in an insulating window unit having disposed therebetween a spacer profile in form of a spacer profile frame 50, adhesive material 61, and sealing material 62.

The spacer profile is shown in FIGS. 3*a*) and *b*) in a cross-section perpendicular to the longitudinal direction, i.e. in a cross-section in the X-Y plane, and extends with this unvarying cross-section in the longitudinal direction Z. The spacer profile is comprised of a profile body 10, which is made of synthetic material, and has a first height h1 in the height direction Y and a first width b1 in the lateral direction X. The synthetic material is an elastically-plastically deformable, poorly heat conducting material.

Here, the term "elastically-plastically deformable" means that elastic restoring forces are active in the material after a bending process, as it is typically the case for synthetic materials, but that a portion of the bend is effected by a plastic, not reversible deformation. Further, with respect to "poorly heat conducting" it should be understood here that the thermal conductivity value $\lambda$ is $\leq$0.4 W/(m K).

The first material is preferably a synthetic material, preferably polyolefin, and more preferably polypropylene, polyethylene terephthalate, polyamide or polycarbonate, as for example acrylonitrile-butadiene-styrene-copolymerisate, Novolen 1040K® or PA66 GF25. The first material has preferably an elastic modulus E1$\leq$3000 N/mm$^2$ and a thermal conductivity value $\lambda$ less than or equal to 0.4 W/(m K), preferably less than or equal to 0.2 W/(m K).

The profile body 10 comprises an inner wall 13 and an outer wall 14, which are spaced apart by a distance h2 in the height direction Y and extend in the lateral direction X. The profile body 10 comprises two side walls 11, 12, which are spaced apart by a distance b2 in the lateral direction X and extend basically in the height direction Y. The sidewalls 11, 12 are connected by the inner wall 13 and the outer wall 14 such that a chamber 20 for accommodating hygroscopic material is formed, the chamber 20 being defined on the respective sides in cross-section by the walls 11 to 14 of the profile body 10. The chamber has a second height h2 in the height direction Y and a second width b2 in the lateral direction X.

The sidewalls 11, 12 serve as abutment bars for the inner sides of the panes 51, 52. The profile body 10 is adhered by the adhesive material 61 in a gas-tight manner to the inner side of the panes 51, 52 via the side walls 11, 12. The inner wall 13 is, in the assembled state of the spacer profile, directed inwardly towards the intervening space 53 between the panes.

The profile body 10 is connected in a materially-bonded manner (for example, connected by fusion or by adhesive) with a one-piece diffusion barrier layer 30, which is preferably formed as a diffusion barrier film. According to the first embodiment, the diffusion barrier layer 30 is formed on the outer sides of the outer wall 14 and side walls 11, 12, both of which outer sides face away from the chamber 20. The diffusion barrier layer 30 extends along the side walls in the height direction Y up to the height h2 of the chamber 20.

The diffusion barrier layer 30 is made of a first metallic material having a second elastic modulus E2 and a first tensile strength R1, and has a first thickness (material thickness) d1.

The first metallic material is preferably a plastically-deformable material. Here, the term "plastically deformable" means that practically no elastic forces are active after the deformation. This is typically the case, for example, when metals are bent beyond their elastic limit. The first metallic material is preferably stainless steel or a steel having an anti-corrosive coating made of tin (such as tinplate) or zinc, where appropriate, as necessary or as desired, having a coating of chrome or chromate.

The tensile strength [N/mm$^2$] is a material property which is independent of the cross-sectional area or the like. It provides a force per unit area, at which the material fails (e.g., tears) when tension is applied. The elastic modulus [N/mm$^2$] is a material characteristic value, which provides a correlation (relationship) between the tension and the elongation when a solid body is deformed.

For the materially-bonded connection of the profile body 10 and the diffusion barrier layer 30, at least one side of the diffusion barrier layer 30 has to be connected to the profile body in a materially-bonded manner.

Here, the term "connected in a materially-bonded manner" means that the profile body 10 and the diffusion barrier layer 30 are permanently connected with each other, for example, by coextrusion of the profile body with the diffusion barrier layer 30, and/or, if appropriate, by use of adhesives. Preferably, the strength of this materiallybonded connection is so large that the materials cannot be separated in the peeling test (for example, according to DIN 53282).

The preferred first metallic material for the diffusion barrier layer 30 is steel or stainless steel having a thermal conductivity value of $\lambda \leq$about 50 W/(m K), preferably $\leq$about 25 W/(m K), and more preferably $\leq$about 15 W/(m K).

The first thickness (material thickness) d1 of the diffusion barrier layer 30 is between 0.30 mm and 0.01 mm, preferably between 0.20 mm and 0.01 mm, more preferably between 0.10 mm and 0.01 mm, and still more preferably between 0.05 mm and 0.01 mm, for example, 0.02 mm, 0.03 mm, or 0.04 mm. Furthermore, it is conceivable that the diffusion barrier layer 30 is formed only as an applied metallic layer having three or less atom layers.

The maximum thickness can be selected in accordance with the desired thermal conductivity value. The thinner the film is, the better the "warm edge"-conditions are fulfilled. In the embodiments shown in FIG. 3*a*) and *b*), thicknesses in the range of 0.10 mm to 0.01 mm are preferred, and more preferred with using the above-mentioned metallic layer having more than three atom layers.

The first tensile strength R1 for this metallic material is in the range of 470 N/mm$^2$ to 800 N/mm$^2$, more preferably in the range of 630 N/mm$^2$ to 740 N/mm$^2$, and is, for example, 500 N/mm$^2$, 580 N/mm$^2$, or 600 N/mm$^2$.

The second elastic modulus E2 is in the range of 195 kN/mm$^2$ to 210 kN/mm$^2$, preferably in the range of 195 kN/mm$^2$ to 199 kN/mm$^2$, and is, for example, 196 kN/mm$^2$, 197 kN/mm$^2$ or 198 kN/mm$^2$.

The elongation at break of the first metallic material is preferably greater than or equal to about 15%, more preferably greater than or equal to about 20%.

An example for a stainless steel film is a steel film 1.4301 or 1.4016 according to DIN EN 1008812 having a thickness of 0.1 mm, and an example for a tin film is a film made of Antralyt E2, 8/2, 8T57 having a thickness of 0.125 mm.

In the W-configuration shown in FIG. 3*a*), the sidewalls 11, 12 each have a concave portion with respect to the chamber 20 that forms the transition from the outer wall 14 to the corresponding sidewalls 11, 12. This design leads to an extension of the heat conduction path through the diffusion barrier layer 30 and, therefore, to an increase of the thermal insulation in comparison with the U-configuration shown in FIG. 4*b*), despite the same height h1 and width b1 of both configurations. In the W-configuration shown in FIG. 3*a*), the volume of the chamber 20 is slightly reduced in comparison to the U-configuration for the same width b1 and height h1.

Further, in the inner wall 13 of the profile body 10, a one-piece reinforcement layer 40, which is preferably formed as a planar reinforcement layer or reinforcement plate, is connected to the profile body 10 in a materially-bonded manner. The reinforcement layer 40 is made of a second metallic material having a third elastic modulus E3 and a second tensile strength R2, and has a second thickness (material thickness) d2.

The reinforcement layer 40 extends over a third width b3 in the lateral direction X. The reinforcement layer 40, which is integrated into the inner wall 13 in accordance with the first embodiment, is horizontally oriented in the X-direction, such that it is preferably centrally arranged. At the same time, the reinforcement layer 40 is disposed between two openings 15, which are adjacently located in the lateral direction x and are disposed in the inner wall 13 close to the transitions of the inner wall 13 to the sidewalls 11, 12 in the lateral direction X, such that the reinforcement layer 40 is arranged in a central position. In the height direction Y, the reinforcement layer 40, which is integrated into the inner wall 13, is oriented such that it is also preferably centrally positioned and, at the same time, is not visible through the upper synthetic material layer, which is directed towards the inner side of the intervening space between the panes. In this embodiment, the synthetic material layers arranged above and below the reinforcement layer 40 have the same material thicknesses as much as possible. The reinforcement layer 40 acts as a reinforcing element.

The second metallic material is preferably a plastically-deformable material. Preferably, the second metallic material is stainless steel or steel having an anti-corrosive coating made of tin (as tin plate) or zinc, if appropriate, having a coating of chrome or chromate.

The preferred material for the reinforcement layer 40 is steel or stainless steel having a thermal conductivity value of $\lambda \leq$about 50 W/(m K), preferably $\leq$about 25 W/(m K), and more preferably $\leq$about 15 W/(m K).

The second thickness d2 is between 0.30 mm and 0.01 mm, preferably between 0.30 mm and 0.05 mm, more preferably between 0.2 mm and 0.08 mm, and still more preferably between 0.20 mm and 0.10 mm, as for example, 0.10 mm, 0.15 mm, or 0.20 mm. In the embodiments shown in FIGS. 3*a*) and *b*), a second thickness d2 in the range of 0.20 mm and 0.10 mm is preferred.

The second tensile strength R2 for the reinforcement layer 40 is in the range of 800 N/mm$^2$ to 2000 N/mm$^2$, preferably in the range of 800 N/mm$^2$ to 1800 N/mm$^2$, more preferably in the range of 800 N/mm$^2$ to 1500 N/mm$^2$, and is, for example, 1000 N/mm$^2$, 1250 N/mm$^2$ or 1300 N/mm$^2$.

The third elastic modulus is in the range of 199 kN/mm$^2$ to 240 kN/mm$^2$, preferably in the range of about 199 kN/mm$^2$ to 210 kN/mm$^2$, for example, it is 205 kN/mm$^2$.

The elongation at break of the reinforcement layer 40 is preferably greater than or equal to about 17%, more preferably greater than or equal to about 25%, or equal to about 60%.

An example for a stainless steel film is a steel film 1.4034 or 1.4419 according to DIN EN 1008812 having a thickness of 0.1 mm.

An improved bending speed can be achieved, e.g., by complying with the following "product relationship" (multiplication relationship) between the reinforcement layer 40 and the diffusion barrier layer 30. The product of the second tensile strength R2 and the second thickness d2 of the reinforcement layer 40 is greater than the product of the first tensile strength R1 and the first thickness d1 of the diffusion barrier layer 30. Alternatively or additionally, the product of the third elastic modulus E3 and the second thickness d2 of the reinforcement layer 40 is greater than the product of the second elastic modulus E2 and the first thickness d1 of the diffusion barrier layer 30. The corresponding products are selected independently of the width of the two layers 30, 40.

According to the first embodiment, for example, d1=d2=0.1 mm. In accordance with the above-set product relationship, it follows therefrom that the reinforcement layer 40 according to a third embodiment has a second tensile strength R2 which is greater than the first tensile strength R1, for example, R2=1500 N/mm$^2$ and R1=630 N/mm$^2$. The product of R2 and d2 is therefore greater than the product of R1 and d1. It follows therefrom that the strength of the reinforcement layer 40 is greater than that of a layer having the same width made of the first metallic material of the diffusion barrier layer 30.

Alternatively or additionally, the reinforcement layer 40 has a larger third elastic modulus E3 than the second elastic modulus E2 of the diffusion barrier layer 30. For example, E3=210 kN/mm$^2$ and E2=195 kN/mm$^2$. It follows therefrom that the product of E3 and d2 is greater than the product of E2 and d1. Thus, the stiffness of the reinforcement layer 40 is greater than that of a layer having the same width made of the first metallic material of the diffusion barrier layer 30.

The hygroscopic material, which is to be filled into the chamber 20, must be in communication with the intervening space between the panes to order to be able to exhibit its effect. For this purpose, the openings 15 are provided in the inner wall 13, the openings 15 are preferably arranged in direct proximity to the sidewalls 11, 12. The openings 15 are arranged such that they do not traverse the reinforcement layer 40. Therefore, the inner wall 13 is intentionally not formed in an impermeable manner.

The non-impermeable design can additionally or alternatively be accomplished by the choice of the material for the entire profile body 10 and/or the inner wall 13 and the reinforcement layer 40 such that the material allows an appropriate diffusion even without the formation of the openings 15. However, the formation of the openings 15 is preferred.

In the assembled state, a moisture exchange can be ensured between the intervening space 53 between the panes and the chamber 20, which is filled with hygroscopic material, through the openings 15 (see also FIG. 1).

All details concerning the first embodiment also apply to all the other described embodiments, except when a difference is expressly noted or is shown in the Figures.

FIGS. 4*a*) and *b*) show a spacer profile according to a second embodiment in a W-configuration and a U-configuration.

The profile body 10 of the spacer profile corresponds to the profile body 10 of the first embodiment. The diffusion barrier layer 30*a* has a first tensile strength R1 and a second elastic modulus E2.

In the second embodiment, the material of a reinforcement layer 40*a* preferably corresponds to the material of the diffusion barrier layer 30*a*. In particular, a second tensile strength R2 of the reinforcement layer 40*a* is equal to the first tensile strength R1 of the diffusion barrier layer 30*a*, and additionally or alternatively, a third elastic modulus E3 is equal to the second elastic modulus E2.

The values for the first thickness (material thickness) d1*a* of the diffusion barrier layer 30*a* correspond in an exemplary manner to the values for the first thickness d1 according to the first embodiment. However, the first thickness d1*a* can also preferably correspond to a value between 0.05 mm and 0.01 mm in accordance with the above-mentioned value range. A second thickness d2*a* of the reinforcement layer 40*a* is, when complying with the above-set product relationship, larger (thicker) than the first thickness d1 in the second embodiment. The second thickness d2*a* is in the above-mentioned value range of d2.

In the shown embodiment, a second thickness d2*a* in the range of 0.3 mm to 0.11 mm is preferred.

For example, according to the second embodiment, d1*a*=0.10 mm, R2=R1=800 N/mm$^2$, and additionally or alternatively E3=E2=199 kN/mm$^2$. According to the product relationship (d2*a*×R2)>(d1*a*×R1), a second thickness d2*a*>d1*a*, for example d2=0.2 mm, follows therefrom.

This in turn results in that the strength and/or stiffness of the reinforcement layer 40*a* is greater than that of a layer having the same width made of the first metallic material of the diffusion barrier layer 30*a*.

FIGS. 5*a*) to *d*) show a spacer according to a third embodiment in a W-configuration and a U-configuration. The profile body 10 of the spacer profile according to the third embodiment corresponds to the profile body 10 of the first embodiment.

According to the third embodiment, a second tensile strength R2 of a reinforcement layer 40*b* is greater than a first tensile strength R1 of the diffusion barrier layer 30*b*. Additionally or alternatively, a third elastic modulus E3 of the reinforcement layer 40*b* is greater than the second elastic modulus E2 of the diffusion barrier layer 30*b*.

The first thickness d1*b* corresponds to the first embodiment. The second thickness d2*b* of the reinforcement layer 40*b* is, in this embodiment, larger than the first thickness d1*b*.

When complying with the above-mentioned product relationship, the product of R2 and d2*b* is greater than the product of R1 and b1. Additionally or alternatively, it follows that the product of E3 and d2*b* is greater than the product of E2 and d1.

For example, d1=0.10 mm, d2*b*=0.20 mm, R1=750 N/mm$^2$, R2=1000 N/mm$^2$, E2=195 kN/mm$^2$ and E3=240 kN/mm$^2$.

This, in turn, results in that the strength and/or stiffness of the reinforcement layer 40*b* is greater than that of a layer having the same width made of the first metallic material of the diffusion barrier layer 30*b*.

It is shown in FIGS. 5*c*) and *d*) that the reinforcement layer 40*b* can also be attached to the side of the inner wall 13 which is directed towards the chamber. In FIG. 5*c*), the reinforcement layer 40*b* is attached to the inner wall 13 in such a manner that the thickness of the inner wall 13 is reduced by the corresponding thickness d2*b* of the reinforcement layer 40*b* in the portion in which the reinforcement layer 40*b* is attached to the inner wall 13. That means, the reinforcement layer 40*b* is embedded in the wall. In FIG. 5*d*), the reinforcement layer 40*b* is attached to the inner wall 13, for example, by an additional adhesive agent. The cross-section of the inner wall 13 of the profile body 10 does not change in the portion, in which the reinforcement layer 40*b* is attached.

In all other embodiments, the reinforcement layer 40*b* can also be attached to the side of the inner wall 13 that is directed towards the chamber.

FIGS. 6*a*) and *b*) show a spacer according to a fourth embodiment in a W-configuration and a U-configuration. The profile body 10 of the spacer profile according to the fourth embodiment corresponds to the profile body 10 according to the first embodiment.

In this embodiment, a second thickness d2*c* is less than the first thickness d1*c*. When complying with the product relationship, the lesser second thickness d2*c* has to be compensated by a correspondingly larger second tensile strength R2. Additionally or alternatively, the smaller second thickness d2*c* can be compensated by a correspondingly larger third elastic modulus E3.

A second tensile strength R2 of the reinforcement layer 40*c* is also greater than a first tensile strength R1 of the diffusion barrier layer 30*c*. Additionally or alternatively, a third elastic modulus E3 of a reinforcement layer 40*c* is greater than the second elastic modulus E2 of the diffusion barrier layer 30*c*.

For example, d1*c*=0.12 mm, d2*c*=0.10 mm, R1=750 N/mm$^2$ and E2=195 kN/mm$^2$. The product relationship is: (d2*c*×R2)>(d1*c*×R1). It follows therefrom that R2>900 N/mm$^2$. Additionally or alternatively, the product relationship is: (d2*c*×E3)>(d1*c*×E2). It follows therefrom that E2>234 kN/mm$^2$.

It follows therefrom that, although d2*c*<d1*c*, the strength and/or stiffness of the reinforcement layer 40*c* is greater than that of a layer having the same width made of the first metallic material of the diffusion barrier layer 30*c*.

By making the second thickness d2*c* of the reinforcement layer 40*c* less than the first thickness d1*c* of the diffusion barrier layer 30*c*, the thermal conductivity through the reinforcement layer 40*c* is decreased.

The combinations of different thicknesses d1, d2, tensile strengths R1, R2, and elastic modulus E2, E3, which are shown in the first four embodiments, can be freely combined with all of the further shown embodiments. The further features of the fourth embodiment, which are described in the following, can be understood as optional features.

The diffusion barrier layer 30 is formed on the outer sides of the outer wall 14 and of the sidewalls 11, 12 that are directed away from the chamber 20. The film 30 extends along the sidewalls in the height direction Y up to the height h2 of the chamber 20. Adjoined thereto, the one-piece diffusion barrier layer 30 comprises profiled extension portions 31, 32, each having a profile 31*a*, 32*a*.

In this context, the term "profile" means that the extension portion is not exclusively a linear extension of the diffusion barrier layer 30, but rather that a two-dimensional profile is formed in the two-dimensional view of the cross-section in the X-Y-plane, which profile is formed, for example, by one or more bends and/or angles in the extension portion 31, 32.

Figure 6:
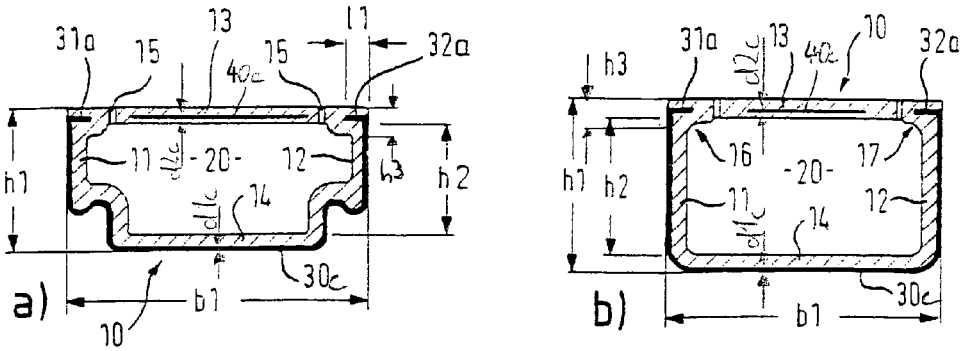
FIG. 6 shows a cross-sectional view of a spacer profile according to a fourth embodiment, in a) in a W-configuration, and in b) in a U-configuration.

In the embodiment shown in FIG. 6, the profile 31*a*, 32*a* comprises a bend (90°) and a portion (flange) connected thereto, which extends inwardly in the lateral direction X from the outer edge of the corresponding sidewall 11, 12 over a length l1. In the embodiment shown in FIG. 6, the largest portion of the extension portion is completely enclosed by the material of the profile body.

Summarizing, it can be said that the extension portion should be located as close as possible to the inner wall. For this reason, the portion of the profile body (receiving portion), in which the extension portion is located (is received), preferably should be located clearly above the central line of the profile in the height direction. In such a case, the extension of the receiving portion from the inner side of the inner wall 13 of the spacer profile in the Y-direction should extend over not more than 40% of the height of the spacer profile. In other words, the receiving portion 16, 17 has a height h3 in the height direction, and the height h3 should be less than or equal to about 0.4 h1, preferably less than or equal to about 0.3 h1, still more preferably less than or equal to about 0.2 h1, and still more preferably less than or equal to about 0.1 h1.

Furthermore, it is advantageous when the mass of the extension portion is at least about 10% of the mass of the remaining portion of the diffusion barrier layer 30, which is located above the central line of the spacer profile in the height direction, preferably at least about 20%, more preferably about 50%, and still more preferably about at least 100%.

FIGS. 7 to 11 show spacer profiles according to a fifth, sixth, seventh, and eighth embodiment which differ from the spacer profiles according to the fourth embodiment in that the design of the extension portions is different. The material of the diffusion barrier layer 30 in the spacer profiles shown in FIGS. 7 to 11 corresponds to the material of the diffusion barrier layer 30 according to the fourth embodiment, but it can also be modified according to the first to the third embodiments.

In all embodiments shown in FIGS. 7 to 11, it is necessarily required that the product of the first thickness d1 and the second elastic modulus E2 and/or of the first thickness d1 and the first tensile strength R1 of the diffusion barrier layer 30 is less than the product of the second thickness d2*c* and the third elastic modulus E3 and/or of the second thickness d2*c* and the second tensile strength R2 of the reinforcement layer 40*c*.

The fifth embodiment of a spacer, which is shown in FIGS. 7*a*) and *b*), differs from the fourth embodiment in that the lengths of the extension portions 31, 32 are nearly twice as long as in the first embodiment, whereas the extension length l1 remains unchanged. This is achieved by providing a second bend (180°) in the profiles 31*b*, 32*b*, and by extending the portion of the extension portion, which is connects to the second bend, again in the lateral direction X, but also outwardly. Thus, a significantly longer length of the extension portion is ensured, wherein the most possible proximity to the inside of the spacer profile is maintained.

Additionally, a portion of the material of the profile body is enclosed on three sides by the profiles 31*b*, 32*b*. This enclosure leads to the fact that the enclosed material functions, in a bending process with compression, as an essentially non-compressible volume element.

With reference to FIGS. 8*a*) and *b*), a spacer profile according to a sixth embodiment is described, wherein in FIGS. 8*c*) and *d*) the portions, which are encircled by a circle in a) or b), are shown in an enlarged manner. The sixth embodiment of the spacer differs from the fourth embodiment in that the diffusion barrier layer 30, inclusive of the extension portions 31, 32, completely extends on the outer side of the profile body 10. Thus, the extension portions 31, 32 and their profiles 31*c*, 32*c* are visible on the inner side (the "outer side" facing the intervening space between the panes) in the assembled state, because they are not covered by the material of the profile body on the inner side, but rather they are exposed. In this embodiment, the extension portion is disposed as close as possible to the inner side.

Figure 5:
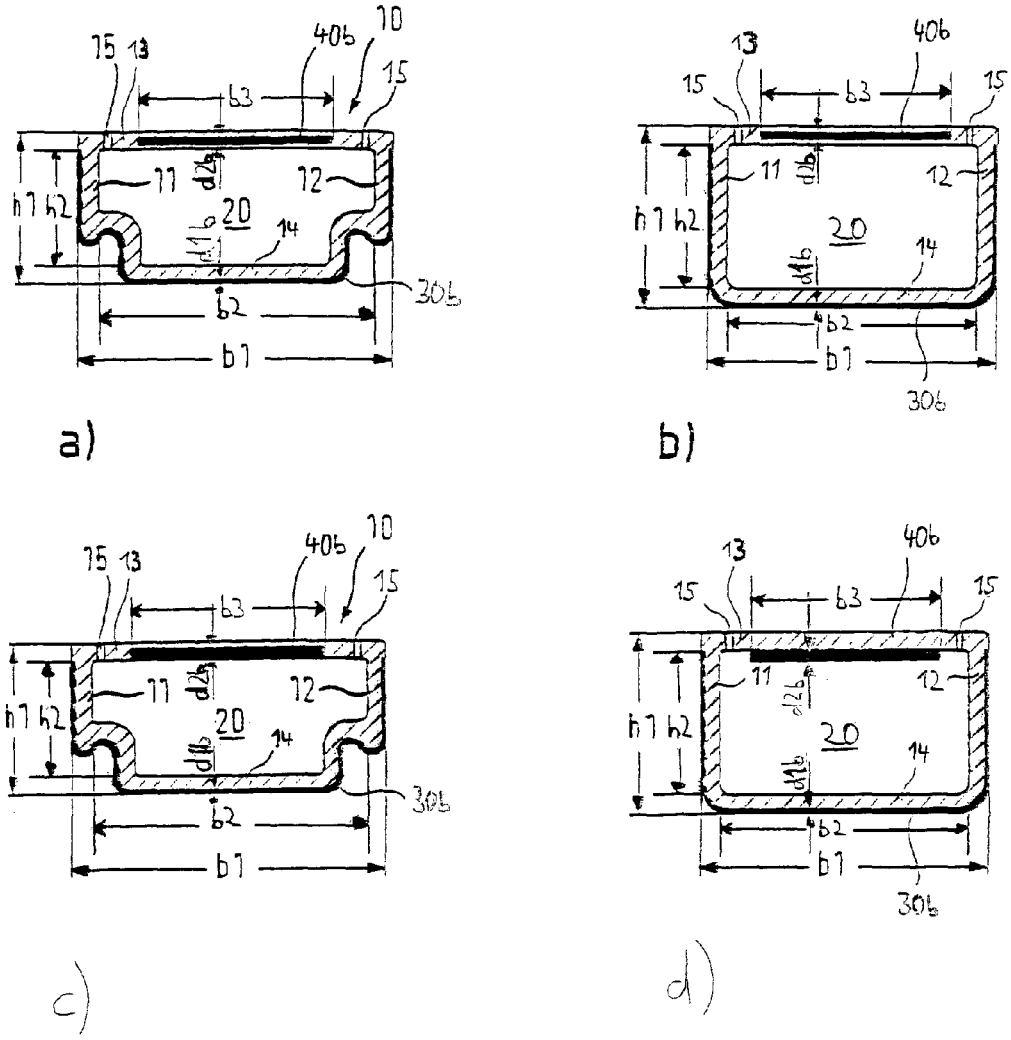
FIG. 5 shows a cross-sectional view of a spacer profile according to a third embodiment, in a) and c) in a W-configuration, and in b) and d) in a U-configuration.
Figure 8:
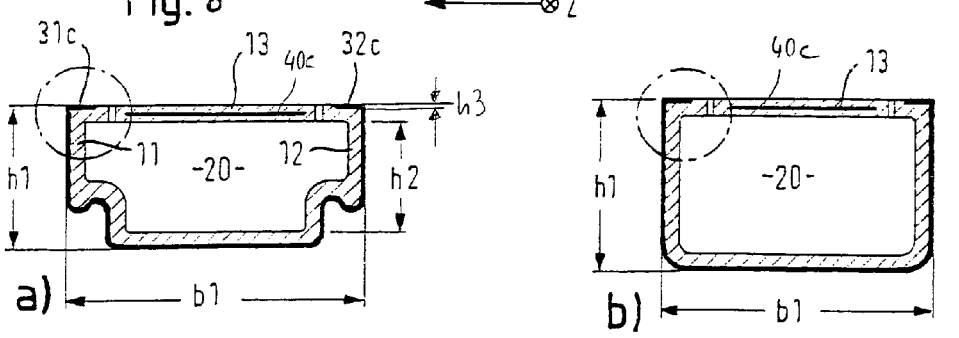
FIG. 8 shows a cross-sectional view of a spacer profile according to a sixth embodiment, in a) in a W-configuration, in b) in a U-configuration, in c) an enlarged view of the portion which is enclosed by a circle in a), and in d) an enlarged view of the portion enclosed by a circle in b).
Figure 8:
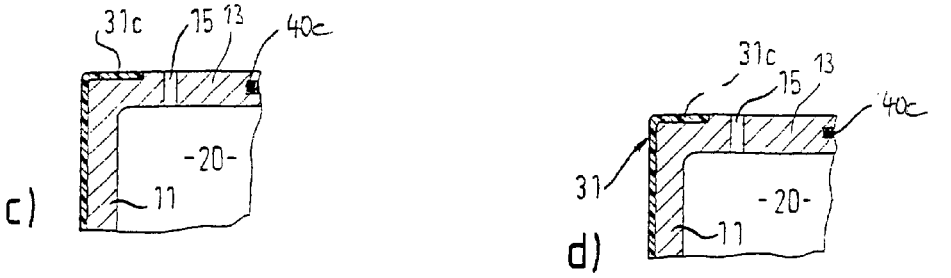
Figure 9:
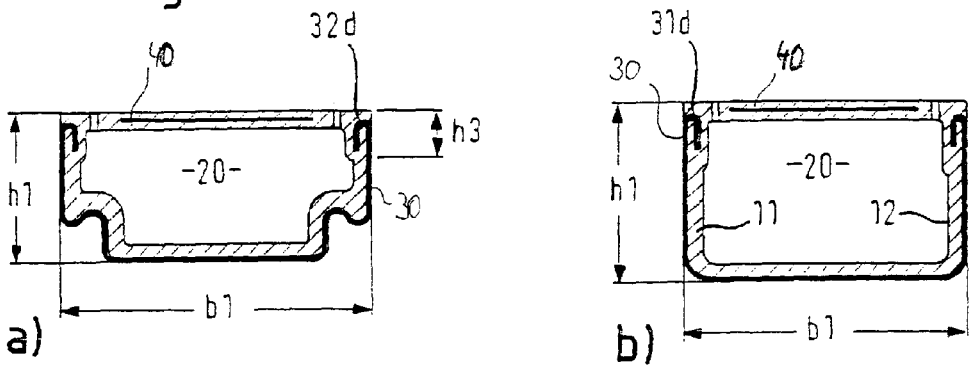
FIG. 9 shows a cross-sectional view of a spacer profile according to a seventh embodiment, in a) in a W-configuration, and in b) in a U-configuration.

The embodiment shown in FIG. 8 may be modified, for example, in that the extension portion 31, 32 is extended and, similar to the embodiment as shown in FIG. 5 (or also in FIGS. 7 to 9), continues inwardly into a receiving portion 16, 17.

In FIGS. 9*a*) and *b*), cross-sections of a spacer profile according to a seventh embodiment are shown. The seventh embodiment differs from the fourth embodiment in that the bend is not a 90°-bend but rather a 180°-bend, such that, in the profiles 31*d*, 32*d*, the portion of the extension portion connecting to the bend does not extend in the lateral direction X, but rather in the height direction Y. Instead, a three-sided enclosure of a portion of the material of the profile body in the receiving portions 16, 17 is achieved, even though only one bend is provided, such that again, when bending the spacer profile with compression, an essentially non-compressibly-acting volume element is provided.

Furthermore, in FIGS. 10*a*) and *b*), cross-sectional views of a spacer profile according to an eighth embodiment are shown. The eighth embodiment differs from the fourth embodiment only in that the radius of curvature of the bend of the profiles 31*e*, 32*e* is smaller than in the seventh embodiment.

In FIGS. 11*a*) and *b*), cross-sectional views of a spacer profile according to a ninth embodiment are shown. The ninth embodiment differs from the fourth to eighth embodiments, which are shown in FIGS. 6 to 10, in that the profiles 31*f*, 32*f* are first bent inwardly by about 45°, then bent by about 45° in the opposite direction, and then bent by a 180° bend with the corresponding three-sided enclosure of a portion of the material of the profile body.

In case the profile or the extension portion has bended, angled and/or folded configurations according to FIGS. 6 to 11, the length (perpendicular to the longitudinal direction in the cross-section) of the profile or of the extension portion, and thus, the mass of the diffusion barrier layer, which has been additionally provided in this section or portion of the spacer profile, can be significantly increased. A displacement of the bending line (elastic line) occurs thereby, which, in turn, results in a reduction of the formation of wrinkles. Furthermore, the sag is remarkably reduced, because the bended, angled, and/or folded profile- and/or extension portion significantly contributes to the strength of the structural integrity of the bent spacer frame.

FIGS. 12*a*) and *b*) show a spacer profile according to a tenth embodiment in a W-configuration and a U-configuration.

The profile body 10 of the spacer profile according to the ninth embodiment corresponds to the profile body 10 of the second embodiment. The material of the diffusion barrier layer 30 corresponds, for example, to the material of the diffusion barrier layer 30 of the second embodiment and has, for example, the same first tensile strength R1 and the same second elastic modulus E2.

The material of the reinforcement layer 40*d* corresponds, for example, to the material of the diffusion barrier layer 30. Accordingly, the second tensile strength R2 and/or the third elastic modulus E3 of the material of a reinforcement layer

40*d* is the same as the first tensile strength R1 and/or the second elastic modulus E2 of the diffusion barrier layer 30.

For example, in accordance with the second embodiment, the first thickness (material thickness) d1 of the diffusion barrier layer 30 is less than a second thickness d2*d* of the reinforcement layer 40*d*.

The profile body 10 has additional openings 15 extending through the inner wall 13 and the reinforcement layer 40*d*. The moisture exchange through the inner wall 13 can be improved thereby.

Figure 13:
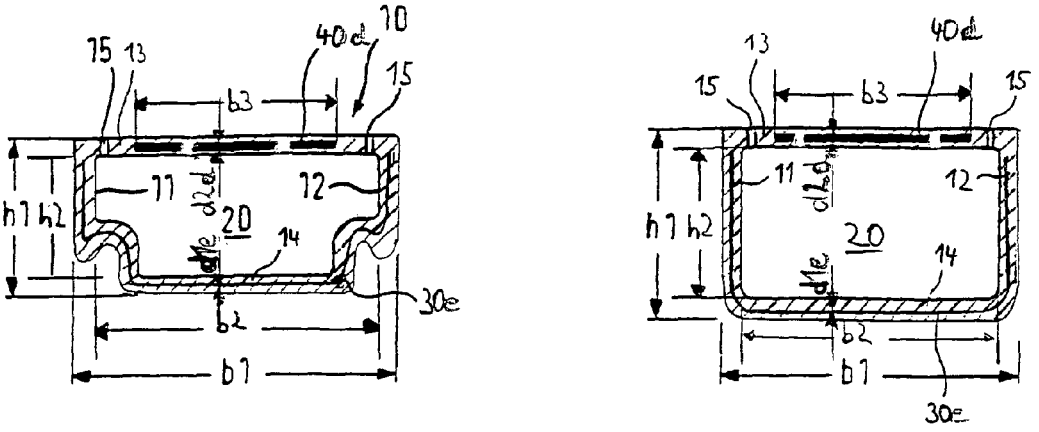
FIG. 13 shows a cross-sectional view of a spacer profile according to an eleventh embodiment, in a) in a W-configuration, and in b) in a U-configuration.

FIGS. 13*a*) and *b*) show a spacer profile according to an eleventh embodiment in a W-configuration and a U-configuration. The spacer profile according to the eleventh embodiment differs from the spacer profile according to the tenth embodiment in that a diffusion barrier layer 30*e* is formed in the outer wall 14 and in the sidewalls 11, 12. It is advantageous when the diffusion barrier layer 30*e* is disposed centrally in the outer wall 14 and when the walls of the profile body 10 uniformly enclose the diffusion barrier layer 30*e*.

The features of the different embodiments can be freely combined with each other. The product of the second tensile strength R2 and the second thickness d2, d2*a*, d2*b*, d2*c*, d2*d* is greater than the product of the first tensile strength R1 and the first thickness d1, d1*a*, d1*b*, d1*c*, d1*e*. Alternatively or additionally, the product of the third elastic modulus E3 and the second thickness d2, d2*a*, d2*b*, d2*c*, d2*d* is always greater than the product of the second elastic modulus E2 and the first thickness d1, d1*c*, d1*e*.

For example, the reinforcement layer shown in FIGS. 12*a*) and *b*) may also have a second thickness d2*d* that is smaller than the first thickness d1*e*.

The diffusion barrier layer can also be formed in one sidewall 11, 12 and attached to the other sidewall 11, 12. Furthermore, the diffusion barrier layer can also be formed on or in the outer wall 14 and on or in the sidewalls 11, 12. The diffusion barrier layer can also be formed completely, or only partly, in or on the sidewalls 11, 12.

Additionally, further openings 15 for connecting the chamber 20 with the intervening space 53 between the panes 51, 52 can be formed in the reinforcement layer 40*d*.

The profile body 10 can also have the shape of a trapezoid, a square, a rhombus or any other shape. The convexity can also have different shapes, for example, being double convex or asymmetrical convex.

The reinforcement layer 40 can extend over the entire width b1, or only partly over the width b1. The reinforcement layer 40 can also be attached in an asymmetrical manner.

Figure 2:
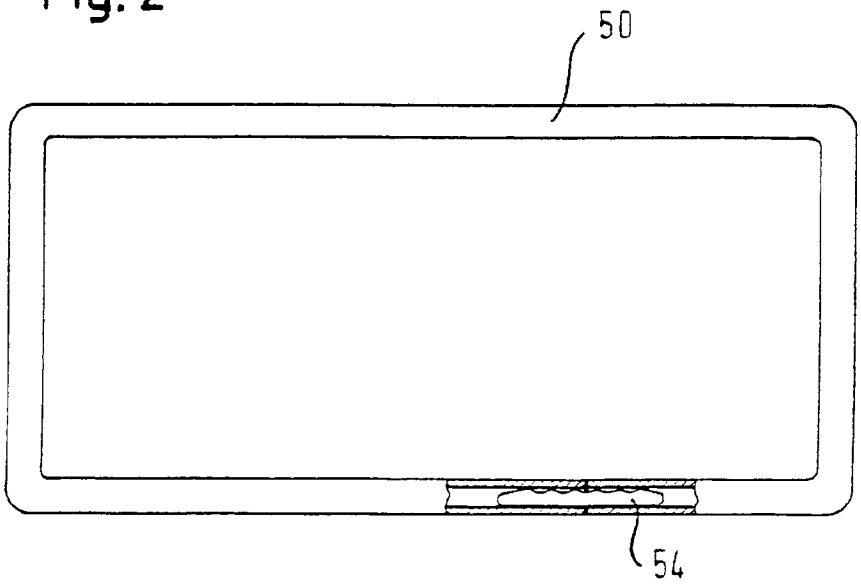
FIG. 2 shows a side view, partially cutaway, of a spacer frame bent from a spacer profile.
Figure 3:
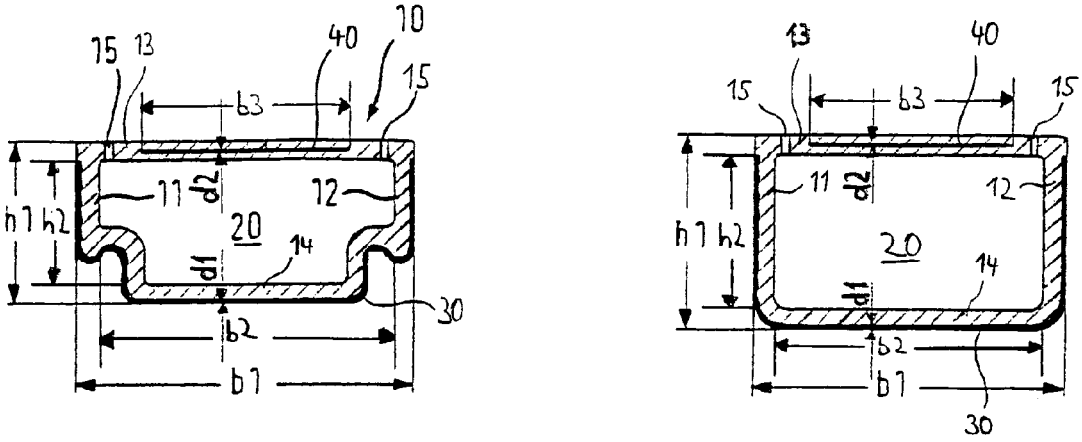
FIG. 3 shows a cross-sectional view of a spacer profile according to a first embodiment, in a) in a W-configuration, and in b) in a U-configuration.
Figure 4:
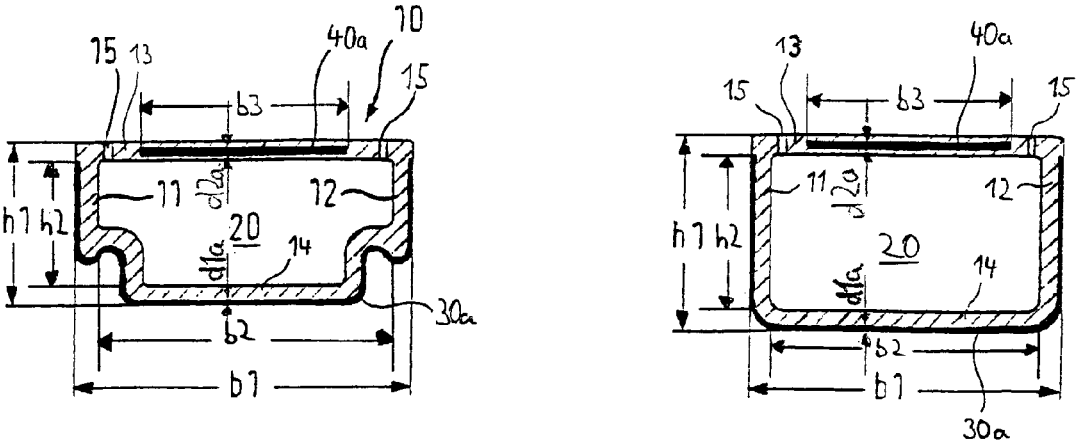
FIG. 4 shows a cross-sectional view of a spacer profile according to a second embodiment, in a) in a W-configuration, and in b) in a U-configuration.

An insulating window unit having a spacer profile frame 50 is manufactured by the following steps. At first, the spacer profile according to one of the above embodiments is manufactured, for example, by extrusion. Subsequently, a spacer profile frame 50 is made from the spacer profile, as shown in FIG. 2, by appropriately bending the spacer profile. Here, particular attention has to be paid to a maximal bending speed. The ends of the spacer profile are joined by a connector. Subsequently, the sidewalls 11, 12 of the spacer profile 50 are respectively adhered with an inner side of the panes 51, 52 using an impermeable adhesive material. The remaining open space between the inner sides of the panes on the side of the spacer profile 50, which face away from the intervening space 53 between the panes 51, 52, and the adhesive material 61 is filled with a mechanically-stabilizing sealing material 62.

Furthermore, the spacer frame can also be joined into a spacer frame from a plurality of, preferably four, separate spacer profiles using corner connectors. To ensure an improved gas impermeability, the solution using the bending process is preferred.

The first and second thicknesses do not have to be constant, but instead can also be, for example, thicker at the edges than in the central portion.

The chamber may also be partitioned by partition walls into a plurality of chambers.

The first height h1 in the height direction Y is between 10 mm and 5 mm, preferably between 8 mm and 6 mm, such as for example, 7 mm, 7.5 mm, and 8 mm.

The second height h2 in the height direction Y is between 9 mm and 2 mm, preferably between 7 mm and 4 mm, such as for example, 4.5 mm, 5 mm, and 5.5 mm.

The first width b1 in the lateral direction X is between 20 mm and 6 mm, preferably between 16 mm and 8 mm, such as for example, 8 mm, 10 mm, and 14 mm.

The second width b2 in the lateral direction X is between 17 mm and 5 mm and preferably between 15 mm and 7 mm, such as for example, 7 mm, 9 mm, and 12.5 mm.

In a W-configuration, the chamber has, in the area of the concave portion, a width in the lateral direction X between 15 mm and 5 mm, such as for example, 10 mm.

In a W-configuration, the chamber has, in the area of the concave portions, a height in the vertical direction Y between 6 mm and 2.5 mm, such as for example, 3.5 mm.

The third width b3 in the lateral direction X is between 20 mm and 4 mm, preferably between 15 mm and 7 mm, such as for example, 6 mm, 8 mm, and 11 mm.

The possible values for the thickness d1 correspond to the possible values for the thicknesses d1*a*, d1*b*, d1*c*, and d1*e*.

The possible values for the thickness d2 correspond to the possible values for the thicknesses d2*a*, d2*b*, d2*c*, and d2*e*.

It is explicitly stated that all features disclosed in the description and/or the claims are intended to be disclosed separately and independently from each other for the purpose of original disclosure as well as for the purpose of restricting the claimed invention, independent of the combinations of the features in the embodiments and/or the claims. It is explicitly stated that all value ranges or indications of groups of units disclose every possible intermediate value or sub-group of units for the purpose of original disclosure as well as for the purpose of restricting the claimed invention, in particular as limits of a range recitation.

The invention claimed is:

1. A spacer profile for use as a spacer frame of an insulating window unit, the spacer profile comprising:

a profile body made of a synthetic material, which extends in a longitudinal direction (Z) and has a first width in a lateral direction (X), which is perpendicular to the longitudinal direction (Z), and a first height in a height direction (Y), which is perpendicular to the longitudinal direction (Z) and to the lateral direction (X), and the profile body has an inner wall in the height direction (Y), which is, in an assembled state of the insulating window unit, directed towards an intervening space between two panes of the insulating window unit, and has an outer wall on the opposite side of the inner wall and sidewalls laterally in the lateral direction so that a chamber for accommodating hygroscopic material is defined, a diffusion barrier layer made of a first metallic material having a first tensile strength and a first thickness the diffusion barrier layer being formed at least on or in the outer wall and at least partly on or in the sidewalls and a reinforcement sheet made of a second metallic material having a second tensile strength and a second thickness the reinforcement sheet being formed in the inner wall or on the side of the inner wall that is directed towards the chamber and wherein the product of the second thickness and the second tensile strength is greater than the product of the first thickness and the first tensile strength.

2. The spacer profile according to claim 1, wherein the first tensile strength is in the range of 630 N/mm$^2$ to 740 N/mm$^2$ and the second tensile strength is in the range of 800 N/mm$^2$ to 1500 N/mm$^2$.

3. The spacer profile according to claim 1, wherein: the diffusion barrier layer extends in one piece in or on the outer wall and in or on the side walls.

4. The spacer profile according to claim 1, wherein: the sidewalls each comprise a concave portion with respect to the chamber, which forms a transition from the outer wall to the corresponding sidewall.

5. The spacer profile according to claim 1, wherein: the diffusion barrier layer, as viewed in a cross-section perpendicular to the longitudinal direction (Z), has a profile extension portion on each of its two side edges.

6. A spacer profile for use as a spacer frame of an insulating window unit, the spacer profile comprising:

a profile body made of a synthetic material, which extends in a longitudinal direction (Z) and has a first width in a lateral direction (X), which is perpendicular to the longitudinal direction (Z), and a first height in a height direction (Y), which is perpendicular to the longitudinal direction (Z) and to the lateral direction (X), and the profile body has an inner wall in the height direction (Y), which is, in an assembled state of the insulating window unit, directed towards an intervening space between two panes of the insulating window unit, and has an outer wall on the opposite side of the inner wall and sidewalls laterally in the lateral direction so that a chamber for accommodating hygroscopic material is defined, a diffusion barrier layer made of a first metallic material having a first tensile strength and a first thickness the diffusion barrier layer being formed at least on or in the outer wall and at least partly on or in the sidewalls and a reinforcement layer made of a second metallic material having a second tensile strength and a second thickness the reinforcement layer being formed in the inner wall or on the side of the inner wall that is directed towards the chamber and wherein the product of the second thickness and the second tensile strength is greater than the product of the first thickness and the first tensile strength, and the second thickness is less than or equal to the first thickness.

7. The spacer profile according to claim 6, wherein: the first tensile strength is in the range of 630 N/mm$^2$ to 740 N/mm$^2$ and the second tensile strength is in the range of 800 N/mm$^2$ to 1500 N/mm$^2$.

8. The spacer profile according to claim 7, wherein: the diffusion barrier layer extends in one piece in or on the outer wall and in or on the side walls.

9. The spacer profile according to claim 6, wherein: the diffusion barrier layer extends in one piece in or on the outer wall and in or on the side walls.

10. A spacer profile for use as a spacer frame of an insulating window unit, the spacer profile comprising:

a profile body made of a synthetic material having a first elastic modulus, which extends in a longitudinal direction (Z) and has a first width in a lateral direction (X), which is perpendicular to the longitudinal direction (Z), and a first height in a height direction (Y), which is perpendicular to the longitudinal direction (Z) and to the lateral direction (X), and the profile body has an inner wall in the height direction (Y), which is, in an assembled state of the insulating window unit, directed towards an intervening space between two panes of the insulating window unit, and has an outer wall on the opposite side of the inner wall, and sidewalls laterally in the lateral direction (X), so that a chamber for accommodating hygroscopic material is defined, a diffusion barrier layer made of a first metallic material having a second elastic modulus, which is greater than the first elastic modulus, and having a first thickness, the diffusion barrier layer being formed at least on or in the outer wall and at least partly on or in the sidewalls, and a reinforcement sheet made of a second metallic material having a third elastic modulus, which is greater than the second elastic modulus, and having a second thickness, the reinforcement sheet being formed in the inner wall or on the side of the inner wall that is directed towards the chamber, and the product of the second thickness and the third elastic modulus is greater than the product of the first thickness and the second elastic modulus, wherein the second thickness is less than or equal to the first thickness.

11. The spacer profile according to claim 10, wherein the second elastic modulus is in the range of 195 kN/mm$^2$ to 199 kN/mm$^2$ and the third elastic modulus is in the range of 200 kN/mm$^2$ to 210 kN/mm$^2$.

12. The spacer profile according to claim 10, wherein the diffusion barrier layer extends in one piece in or on the outer wall and in or on the side walls.

13. The spacer profile according to claim 10, wherein the sidewalls each comprise a concave portion with respect to the chamber, which forms a transition from the outer wall to the corresponding sidewall.

14. The spacer profile according to claim 10, wherein the diffusion barrier layer, as viewed in a cross-section perpendicular to the longitudinal direction (Z), has a profile extension portion on each of its two side edges.

15. The spacer profile according to claim 10, wherein: the second elastic modulus is in the range of 195 kN/mm$^2$ to 199 kN/mm$^2$ and the third elastic modulus is in the range of 200 kN/mm$^2$ to 210 kN/mm$^2$.

16. The spacer profile according to claim 15, wherein: the diffusion barrier layer extends in one piece in or on the outer wall and in or on the side walls.

17. The spacer profile according to claim 10, wherein: the diffusion barrier layer extends in one piece in or on the outer wall and in or on the side walls.

18. An insulating window unit, comprising:

at least two panes that mutually oppose each other with a space therebetween for forming an intervening space between the panes, and a spacer frame made of a spacer profile according to claim 4, which is disposed between the panes such that the, in the lateral direction (X), outer sides of sidewalls are adhered by an impermeable adhesive material to the sides of the panes that are directed towards the sidewalls and the spacer frame thus defines the intervening space between the panes.

19. An insulating window unit, comprising:

at least two panes that mutually oppose each other with a space therebetween for forming an intervening space between the panes, and a spacer frame made of a spacer profile according to claim 1, which is disposed between the panes such that the, in the lateral direction (X), outer sides of sidewalls are adhered by an impermeable adhesive material to the sides of the panes that are directed towards the sidewalls and the spacer frame thus defines the intervening space between the panes.

* * * * *